United States Patent [19]

Rohr

[11] Patent Number: 4,512,268

[45] Date of Patent: Apr. 23, 1985

[54] METHOD AND APPARATUS FOR TENSIONING AND SEWING A TUBULAR WORKPIECE

[75] Inventor: Gunter H. Rohr, Hemmingen, Fed. Rep. of Germany

[73] Assignee: Union Special GmbH, Stuttgart, Fed. Rep. of Germany

[21] Appl. No.: 436,764

[22] Filed: Oct. 26, 1982

[30] Foreign Application Priority Data

Oct. 29, 1981 [DE] Fed. Rep. of Germany ..... 3142836

[51] Int. Cl.[3] ..... D05B 35/00

[52] U.S. Cl. ..... 112/63; 112/121.27; 112/262.2; 474/110; 474/132

[58] Field of Search ..... 139/311; 38/102.1, 102.4, 38/102.5, 102.6, 102.7, 102.8; 223/15, 74, 77; 160/378; 112/121.26, 262.2, 63, 121.27, 220; 474/113, 101, 102, 103, 104, 109, 110, 132

[56] References Cited

U.S. PATENT DOCUMENTS

| | | | |
|---|---|---|---|
| 356,355 | 1/1887 | Fisher | 474/113 X |
| 388,497 | 8/1888 | McLoughlin | 223/15 |
| 1,299,566 | 4/1919 | Emory | 474/113 |
| 1,302,313 | 4/1919 | Coppage | 474/132 |
| 1,634,051 | 6/1927 | Parsch | 223/15 |
| 2,552,725 | 5/1951 | Laquerre | 474/113 |
| 2,684,190 | 7/1954 | Glover, Jr. | 223/74 |
| 3,187,674 | 6/1965 | Hammelmann | 474/110 X |
| 3,572,149 | 3/1971 | Cain et al. | 474/110 |
| 3,865,058 | 2/1975 | Rovin et al. | 112/63 |
| 4,191,117 | 3/1980 | Della Torre | 112/121.26 |

FOREIGN PATENT DOCUMENTS

| | | | |
|---|---|---|---|
| 1128243 | 2/1959 | Fed. Rep. of Germany | 474/113 |
| 2730291 | 1/1979 | Fed. Rep. of Germany | 112/121.26 |
| 2016646 | 9/1979 | United Kingdom | 474/113 |

*Primary Examiner*—Werner H. Schroeder
*Assistant Examiner*—Andrew M. Falik
*Attorney, Agent, or Firm*—John W. Harbst; John A. Schaerli

[57] ABSTRACT

An apparatus for supporting and tensioning a tubular workpiece edge such that the edge may be linearly advanced beneath the stitch forming instrumentalities of a sewing machine. The tensioning apparatus includes at least two rotative assemblies which are insertable within the closed loop formation of the workpiece edge. One of the rotative assemblies being connected to a balanced tensioning arm and is adapted for movement between two operative positions in a manner whereby applying a constant circumferential workpiece edge tension on all article sizes.

18 Claims, 3 Drawing Figures

FIG. 2
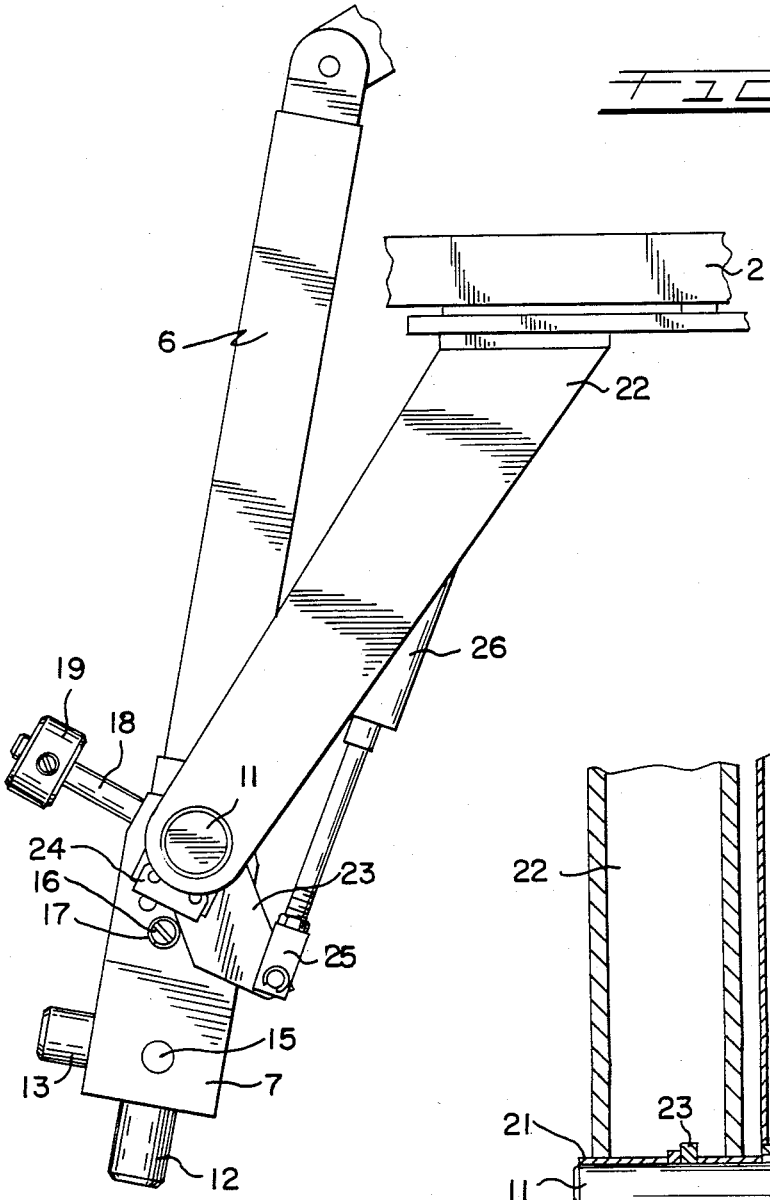
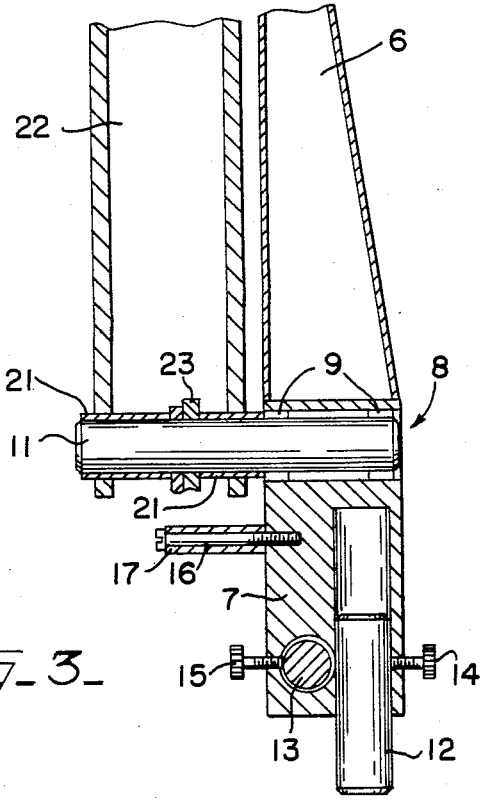
FIG. 3

METHOD AND APPARATUS FOR TENSIONING AND SEWING A TUBULAR WORKPIECE

FIELD OF THE INVENTION

The present invention generally relates to sewing machines and, more particularly, to a method and apparatus operatively associated with the machine for supporting and tensioning the workpiece edge to be sewn.

BACKGROUND OF THE INVENTION

It is heretofore been difficult to automatically and mechanically perform the finish sewing operating along the free end of a looped or tubular workpiece article. This problem is only enhanced when operating along the open edge of a stretch type material. Devices as shown in U.S. Pat. Nos. 1,723,781 and 3,736,895, although directed toward the problem, have not offered a complete solution. Usually, the tensioning force applied by such devices is not responsive to the particular workpiece being sewn. Instead, a fixed degree of movement is imparted to the movable tensioning roller. As is appreciated, however, varying sized workpieces necessarily require varying degrees of movement of the tensioning roller depending upon the particular size of the garment being sewn. Therefore, the technical problem remaining to be solved is that of sensitively controlling the amount or degree of circumferential tension to be applied to the tubular workpiece edge while still allowing for quick and easy insertion and removal of the workpiece from the tensioning device. The technical problem to be solved is enhanced when considering the tensioning devices are to be applied to an automatic sewing machine.

SUMMARY OF THE INVENTION

In light of the above and in accordance with the present invention, there is provided a method and apparatus for tensioning a tubular workpiece edge of an article in a unique manner controlled by the particular workpiece being sewn. The solution to the heretofore mentioned problem involves a method in accordance with the present invention wherein a tubular workpiece edge is arranged over a spaced pair of support members and then an outwardly directed pressure is applied to one of said support members whereby moving same in a generally horizontal direction. The outward pressure of the movable roller or support member results from the momentum of the movable support member moving from a rest position to a position defined by the particular workpiece being tensioned.

To accomplish such a method requires an apparatus that includes a tensioning device having at least two freely rotatable or driven roller assembly means. Unlike the heretofore known devices, however, the present invention mounts one of said roller assembly means on a lightweight, fulcrumed lever means for free movement away from the other roller assembly means. The other end of the fulcrumed lever is provided with a balancing means. The balancing means includes counterweight means for offsetting the weight or mass of the freely movable roller assembly arranged at the opposite end of the lever. Additionally, other counterweight means are adapted to influence the movable roller assembly such that it produces the proper circumferential tension to the particular workpiece edge being operated upon or along. The provision of the additional counterweight means allows for a sensitive adjustment of the tension applied by the roller assembly means. Furthermore, such an arrangement allows for and readily adjusts to changes in the particular size of the workpiece that is being sewn. A positive drive means, arranged in operative association with the fulcrumed lever, provides for the quick movement of the balanced tensioning roller assembly upon completion of the sewing operation to allow for removal of the workpiece.

In line with the above, a primary object of this invention is the provision of an apparatus for applying circumferential tension to the particular workpiece edge being sewn.

Another object of this invention is the provision of a simple, yet effective, apparatus adapted for stretching various sized tubular workpiece edges under a constant tension.

Still another object of this invention is the provision of an apparatus for stretching a tubular workpiece edge as a function of the particular edge being sewn and substantially independent of other variables.

Another object of this invention is the provision of an apparatus which utilizes its own momentum to generate a constant tension to all sizes of workpieces or articles to be sewn.

BRIEF DESCRIPTION OF THE DRAWINGS

Having in mind that additional objects and other attendent advantages may well become apparent from an understanding of this disclosure, the invention comprises the devices, combinations and arrangements of parts as illustrated in the presently preferred form of the invention which is here and after set forth in detail to enable those skilled in the art to readily understand the function, operation, construction and advantages of same when read in conjunction with the accompanying drawings in which:

FIG. 2 is an enlarged partial view of the tensioning device of the present invention; and FIG. 3 is a partial sectional view of the fulcrumed tensioning apparatus.

DETAILED DESCRIPTION OF THE PRESENT INVENTION

Figure 1:
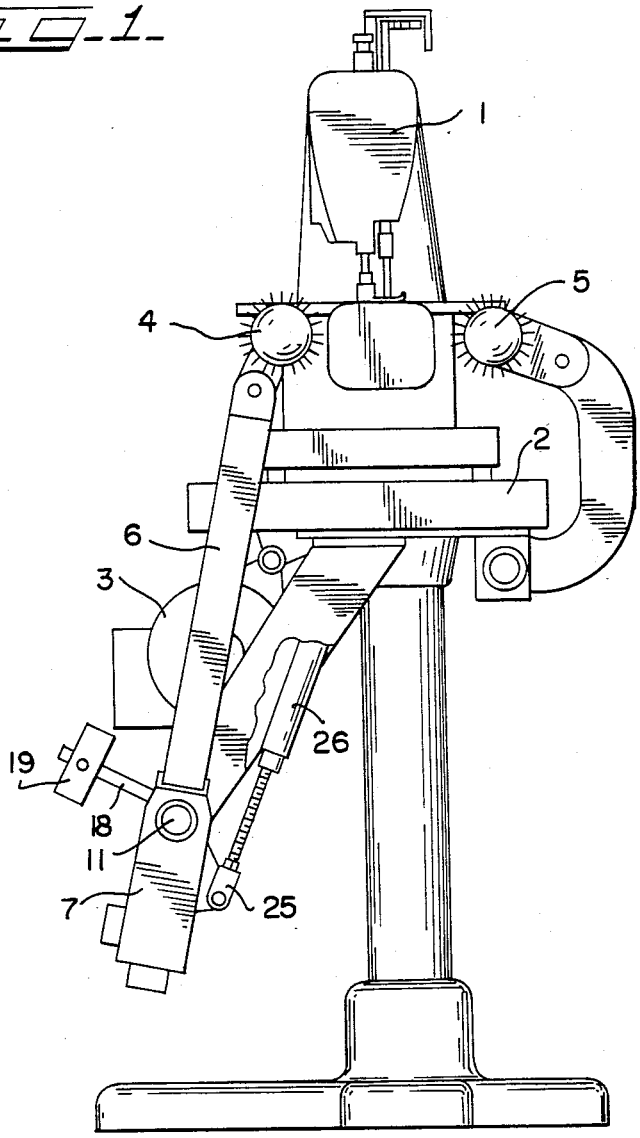
FIG. 1 is an elevational view of a table mounted sewing machine having the present invention applied thereto.

Referring now in detail to the drawings, wherein like reference numerals indicate like parts throughout the several views, in FIG. 1 there is shown a commercial sewing machine 1. The sewing machine, which includes the usual stitch forming instrumentalities or devices, may be arranged on a base or frame structure 2. A motor or drive apparatus 3 supplies the necessary power to the machine to enable its stitch forming instrumentalities to operate along the advancing edge of a tubular workpiece. Also supported on the sewing machine mounting structure or frame is a tensioning apparatus or device including a spaced pair of support roller assembly means 4 and 5. The roller assembly means are adapted to engage and manipulate a tubular workpiece in the manner provided by the present invention. A detailed description of the support roller assembly apparatuses of the present invention may be found in my co-pending U.S. patent application, Ser. No. 372,366, filed Apr. 27, 1982, U.S. Pat. No. 4,467,734. Suffice it to say, either freely rotatably or driven roller assemblies may be utilized without altering or deterring from their intended function. Each roller's rotative axis extends substantially parallel with the other and in a plane extending substantially parallel to the work supporting surface of the machine. The axial length of each roller assembly means may be, and typically is, substantially less than the axial length of the workpiece being sewn.

As best seen in FIG. 1, the roller assemblies 4 and 5 are disposed on opposite sides of the machine's stitch forming instrumentalities in the direction of workpiece advancement. As will be subsequently described, one of the roller assembly means, i.e. roller assembly 4 in the embodiment shown, is automatically movable in a generally horizontal direction while the other roller assembly is held generally stationary relative the frame 2. Thus, the distance between the roller assembly means may be adjusted to adapt to the diameter of the circumferential workpiece to be sewn. The adaptability of the present invention to various workpiece sizes is, thus, apparent.

The means for tensioning or stretching the tubular workpiece to be sewn will now be described. As reflected in FIG. 1, the roller assembly means 4 is arranged, in a cantilevered fashion, on one free end of a freely rotatable, lightweight tensioning arm 6. Intermediate its ends, the extended tensioning arm 6 is fulcrumed on a pivot support means 8. By such construction, the movable roller assembly may be shifted in two horizontal and opposite directions extending substantially parallel with the direction of workpiece advancement. As best seen in FIG. 3, the pivotal support means 8 for the extended lever arm 6 may include an outwardly projecting pin 11 journaled for rotative movement in the bushings 21 carried by a depending member 22. Preferably, a set of roller bearing means 9 will be arranged intermediate the pin 11 and the lever arm 6 to allow rotative movement therebetween.

At its lowermost end, the tensioning arm 6 may be formed with an equalizer or balancing means 7 which, in cooperation with the positional arrangement of the pivot support means 8, counter balances the weight of the roller assembly means 4 carried at the opposite end of the lever 6. In the illustrated apparatus, the equalizer means includes first and second static balancing weight means 12 and 13 which are adjustably secured to the arm 6 by fastener means 14 and 15, respectively to offset the weight of the roller assembly means 4. Depending on the adjustment of the static weights, the balanced position of the arm 6 and the roller assembly associated therewith about the pivot may be varied depending on the particular workpiece size being sewn. As should be understood, the balancing means 12 and 13 also serve to impart momentum to the movable tensioning roller assembly such that when the roller assembly is released from its rest position, it automatically moves outwardly, thus, urging the roller assemblies apart. That is, the weight unbalance inherent in the system resulting from the roller assembly means 4 being arranged at one end of the tensioning arm 6 is overcome by the balancing means arranged on the opposite end of the lever 6. An additional counterweight or tensioning means may be selectively secured on a pin 19 projecting outward from the lever 6. Such weight means enables the lever and roller assembly 4 to overcome their balanced state and to be positioned such that a constant circumferential tensioning force is exerted on the workpiece edge to be sewn. As should readily be understood, by such construction, the extent of tensioning force applied to any particular garment by the movable roller assembly will be limited and controlled by the particular garment being sewn.

In accordance with one aspect of this invention, means may be provided for controllably effecting a positive but limited movement of the tensioning arm 6. As best seen in FIG. 2, a lever arm 23 may be secured to the pivotal support shaft 11. In one direction of forced movement, the lever arm 23 cooperates with a stop member 16 carried on the lower end of lever arm 6. The lever arm 23 cooperates with the stop member 16 to move the roller assembly 4 toward the other roller assembly 5 and into a rest position illustrated in FIG. 1. If desired, the stop member or lug 16 may be provided with a sleeve 17. For imparting a controlled positive drive force to the lever 6, the operative end 25 of a drive actuator 26 may be connected to the free end of the lever 23. For purposes of this description, suffice it to say that the drive actuator is a double pneumatic cylinder but any similar drive apparatus or actuating means may suffice. As will be subsequently described, the operation of the drive member 26 is controlled by a switch means 24 which is arranged for movement with the shaft 11. The switch means 24 serves to monitor the angular disposition of the lever arm 6 and ultimately controls the disposition of the movable roller assembly in its rest position.

In the starting condition of the apparatus of the present invention, the movable roller assembly is held in a rest position whereat the spaced distance between the roller assemblies is minimized. To move the movable roller assembly into its initial or rest position, the operative end of the drive actuator is distended whereby the lever 23 turns until it engages the stop member 16. As will be readily appreciated, continued movement or distention of the actuator will positively drive the arm 23 and with it the lever arm 6 in a clockwise direction as shown in FIG. 1. The final or rest position of the movable roller assembly may be selectively controlled by the positional arrangement of the switch means 24 relative to the stop member 16.

At this stage, an operator axially positions the open end of a tubular workpiece or article over both the roller assembly means. In such position, the roller assembly means may engage the inner surface adjacent one end of the workpiece. Also, in such position, the free or open end of the workpiece edge is arranged to pass beneath the stitch forming instrumentalities of the machine during operation of the apparatus.

Having arranged a workpiece over the rotative members 4 and 5, the operator is ready to initiate machine operation. Actuaction of the machine by the operator causes the operative end 25 of the actuator 26 to be forceably retracted whereby releasing the movable roller assembly means from its rest position. Once released from its rest position, the momentum of the arm resulting from the effects of the weight 19 and balancing means causes the movable roller to automatically move, in a generally horizontal direction, away from the other roller assembly. The horizontal movement of the roller assembly results in a tensioning and holding force to be exerted on the workpiece by the support member. The degree or amount of tension applied to the circumferential workpiece edge is controlled by two considerations. First, the particular size of the workpiece being sewn. Second, the adjustable effect of the adjustable weight 19 on the lever arm 6 and, ultimately, on the movable tensioning roller.

As mentioned, the forceable retraction of the actuator is controlled by the switch means 24. Upon retraction of the operative end of the driver 26, the shaft 11 and with it the switch means 24 is forceably turned causing the switch to run against the stop 16. When the switch means passes the stop 16 it changes state whereby switching off the actuator. The switch means 24 is allowed to pass beyond the stop 16 without any effect in that it switches in one direction only.

Upon completion of the sewing operation, the movable roller assembly is returned to its initial or rest position in the manner described above. That is, the distention of the actuator's operative end 26 forceably drives the lever 23 into engagement with the stop member 16 whereby forceably rotating or rocking the lever arm 6 and with it the roller assembly about the pivotal support means. Such rocking motion continues until the rest position of the movable roller assembly is sensed by the change of state of switch means 24. The return of the movable roller to its initial or rest position permits the easy removal of the completed article from the apparatus thus readying the apparatus and machine for further cycle of operation.

Thus it is apparent that there has been provided, in accordance with the invention a Method And Apparatus For Sewing Tubular Workpieces that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Thus, having adequately described my invention, what I claim is:

1. A tensioning device arranged in combination with an automatic sewing machine capable of sewing along an advancing edge of a tubular workpiece article and having a work supporting surface, said tensioning device comprising:

at least two rotatable tensioning parts for supportably receiving a tubular workpiece edge portion of the article to be sewn; and means for mounting said tensioning parts on opposite sides of said sewing machine in the direction of the article's advancement, said mounting means including means for holding one of said tensioning parts in a fixed relationship relative to said sewing machine and means responsive to machine actuation for automatically moving the other tensioning part away from the first tensioning part to a free floating position determined by the size of the tubular workpiece edge portion arranged thereabout and along a path extending substantially parallel to said work supporting surface whereby applying a constant predetermined tension to the workpiece edge regardless of the article's size.

2. In cooperation with a table mounted sewing machine, an apparatus for working on a tubular workpiece edge, said apparatus comprising:

a tensioning device supported on said sewing machine table mount including at least two tension roller means for engaging the inner surface adjacent one end of the tubular workpiece and wherein one of said tension roller means is movable relative to the other roller means along a substantially horizontal path during a sewing operation; and machine actuated means for mounting the movable tension roller means such that upon machine actuation said movable tension roller means automatically moves under the influence of preadjusted static means away from said other tension roller means an extent controlled by the size of the workpiece arranged thereabout, said preadjusted static means being carried by said mounting means.

3. In cooperation with an automatic sewing machine adapted to operate along an advancing edge portion of a workpiece, a tensioning apparatus comprising:

at least two workpiece supporting assemblies adapted to receive and rotatably support the advancing edge portion of the workpiece in the form of a loop; and means responsive to machine actuation for supporting and automatically moving one of said supporting assemblies in the direction of workpiece advancement from a rest position away from said other supporting assembly to a free floating position whereby applying a generally constant level of tension to the workpiece edge regardless of the particular workpiece size being sewn.

4. The invention according to claim 3 further including means for monitoring the disposition of said movable workpiece supporting assembly.

5. In cooperation with a sewing machine adapted to work along an advancing edge of a material workpiece, a tensioning apparatus comprising:

at least two workpiece engaging members, said members being positioned in a closed loop formed by said workpiece; and machine actuated stretching means for automatically removing one of said workpiece engaging members from a rest position and moving it away from the other engaging member in the direction of workpiece advancement to a free floating position defined by the size of the particular workpiece arranged about the engaging members whereby tensionally distending the workpiece edge under a constant tension and along a substantially horizontal path.

6. The invention according to claim 5 wherein said stretching means includes a fulcrumed lever having said associated workpiece engaging member arranged at one end thereof.

7. In cooperation with an automatic sewing machine adapted to operate along the edge of an advancing workpiece, a stretching apparatus comprising:

a pair of workpiece support members positioned for axial reception within an open end of a tubular workpiece; and means for mounting one of said workpiece support members to automatically move in response to machine operation and in an outward direction relative to said other workpiece support member to place the open end of said workpiece under circumferential tension, said mounting means includes a fulcrumed balancable lever having said movable workpiece support member carried at one end thereof, balancing means compensating for the mass of the movable support member and for influencing the balanced position of said lever, and static means carried on said lever means for exerting a tension on the circumferential workpiece edge.

8. A sewing machine having a frame for supporting same and an apparatus adapted to support the edge of a tubular workpiece in a loop formation such that the supported workpiece edge may be advanced beneath stitch forming instrumentalities of the machine during a sewing operation, said apparatus comprising:

a device mounted on the frame including at least two roller assembly means for engaging the inner surface of the workpiece edge arranged to pass beneath the stitch forming instrumentality; and operative means capable of supporting one of said roller assembly means for movement in two opposite directions extending substantially parallel with the direction of workpiece advancement, said operative means includes a balanced pivotal lever means including said movable roller assembly arranged at one end and weight means arranged on said lever means such that upon machine actuation said movable roller assembly means moves away from said other roller assembly means to a free floating position whereby applying a premeasured constant circumferential tension to said workpiece edge regardless of its size.

9. A tensioning device arranged in combination with a sewing machine having a work supporting surface, said tensioning device comprising:

at least two rotatable tensioning parts adapted to supportably receive a tubular workpiece edge portion; and means for mounting said tensioning parts on opposite sides of said sewing machine in the direction of workpiece advancement, said mounting means including means for holding one of said tensioning parts in a fixed relationship relative to said sewing machine and automatic means responsive to machine actuation, said automatic means including: a balancable fulcrumed lever means having said other tensioning part arranged at one end thereof, said lever means providing for movement of said other tensioning part relative to said first tensioning part whereby the size of the tubular workpiece edge portion arranged thereabout controls the extent of movement of the movable tensioning part away from the other tensioning part between a rest position and a free floating position, first operative means associated with said fulcrumed lever means for compensating for the weight of the tensioning part and for setting the balanced position for said lever means and the tensioning part carried thereby, and second operative means carried by said lever means for effecting movement of said movable tensioning part beyond its balanced position whereby applying a constant predetermined amount of tension to said workpiece.

10. In cooperation with a sewing machine adapted to work along the advancing edge of a material workpiece, a tensioning apparatus comprising:

at least two workpiece engaging members, said members being positioned in a closed loop formed by said workpiece; and stretching means operatively associated with one of said workpiece engaging members for tensionally distending the workpiece edge in the direction of workpiece advancement to a size defined by the particular workpiece arranged about the engaging members, said stretching means includes a balanced fulcrumed lever having said associated workpiece engaging member arranged at one end thereof and means responsive to machine actuation for effecting movement of said lever to a free floating position located beyond the balanced state of the lever whereby exerting tension on said workpiece edge.

11. The invention according to claim 10 wherein said balancing means includes a first counterweight means adapted to compensate for the mass of said workpiece engaging member arranged at the end of said lever means and a second counterweight means arranged apart from said first counterweight means for influencing the position of said movable workpiece engaging member.

12. The invention according to claim 11 wherein said second counterweight means is adjustable.

13. In cooperation with an automatic sewing machine adapted to operate along an advancing edge portion of a workpiece, a tensioning apparatus comprising:

at least two workpiece supporting assemblies adapted to receive and rotatably support the advancing edge protion of the workpiece in the form of a loop;

means operatively associated with one of said supporting assemblies for automatically moving same in response to machine actuation and in the direction of workpiece advancement from a rest position away from said other supporting assembly to a free floating position to effect tensioning of the workpiece edge to an extent defined by the particular workpiece being sewn; and drive means for positively moving said movable workpiece supporting assembly toward the other workpiece supporting assembly upon completion of a sewing operation.

14. The invention according to claim 13 wherein said drive means includes a pneumatic cylinder means.

15. A tensioning device arranged in combination with a sewing machine having a work supporting surface, said tensioning device comprising:

at least two rotatable tensioning parts adapted to supportably receive a tubular workpiece edge portion; and means for mounting said tensioning parts on opposite sides of said sewing machine in the direction of workpiece advancement, said mounting means including means for holding one of said tensioning parts in a fixed relationship to said sewing machine and balanced means responsive to machine actuation for automatically moving the other tensioning part under a predetermined force away from the first tensioning part to a free floating position determind by the size of the tubular workpiece edge portion arranged thereabout and along a path extending substantially parallel to said work supporting surface.

16. A tensioning device arranged in combination with a sewing machine having a work supporting surface, said tensioning device comprising:

at least two rotatable tensioning parts adapted to supportably receive a tubular workpiece edge portion; and means for mounting said tensioning parts on opposite sides of said sewing machine in the direction of workpiece advancement, said mounting means including means for holding one of said tensioning parts in a fixed relationship relative to said sewing machine and means responsive to machine actuation for automatically moving the other tensioning part away from the first tensioning part an extent determined by the size of the tubular workpiece edge portion arranged thereabout and along a path extending substantially parallel to said work supporting surface, wherein said means for automatically moving the other tensioning part includes an extended, fulcrumed lever means having said other tensioning part arranged at one end thereof and radially adjustable weight means disposed proximate the other end thereof.

17. A method for tensioning the open ended edge of a tubular workpiece for presentation to a sewing machine comprising the steps of:

arranging the open end of a tubular workpiece over a spaced pair of rotatable support members; and automatically moving one of said rotatable support members from a rest position and away from the other support member to a free floating position in response to machine actuation whereby placing the arranged open end of the tubular workpiece under a predetermined and constant circumferential tension regardless of the workpiece's circumferential size.

18. The method according to claim 17 further including the step of automatically returning the movable support member to its rest position to facilitate removal of the workpiece from about the spaced pair of rotatable support members.

* * * * *